United States Patent [19]

Kishita et al.

[11] Patent Number: 4,847,190

[45] Date of Patent: Jul. 11, 1989

[54] MANUFACTURING PROCESS FOR SILVER HALIDE PHOTOGRAPHIC EMULSION

[75] Inventors: Takehisa Kishita; Toshiharu Nagashima; Takeshi Murakami, all of Hino, Japan

[73] Assignee: Konishiroku Photo Industry Co., Ltd., Tokyo, Japan

[21] Appl. No.: 277,412

[22] Filed: Nov. 29, 1988

Related U.S. Application Data

[63] Continuation of Ser. No. 20,147, Feb. 26, 1987, abandoned, which is a continuation of Ser. No. 772,129, Aug. 30, 1985, abandoned.

[30] Foreign Application Priority Data

Sep. 13, 1984 [JP] Japan ..... 59-193339

[51] Int. Cl.[4] ..... G03C 1/36; G03C 1/485

[52] U.S. Cl. ..... 430/569; 430/596; 430/605; 430/606

[58] Field of Search ..... 430/569, 605, 606, 596, 430/567

[56] References Cited

U.S. PATENT DOCUMENTS

| | | | |
|---|---|---|---|
| 3,501,307 | 3/1970 | Illingsworth | 430/597 |
| 3,672,900 | 6/1972 | Kurz | 430/569 |
| 3,901,713 | 8/1975 | Yamasue et al. | 430/569 |
| 4,242,445 | 12/1980 | Saito | 430/569 |
| 4,288,535 | 9/1981 | Kanisawa et al. | 430/569 |
| 4,334,012 | 6/1982 | Migot | 430/569 |
| 4,469,783 | 9/1984 | Kuwabara et al. | 430/569 |
| 4,495,274 | 1/1985 | Yoshida | 430/597 |
| 4,533,627 | 8/1985 | Yates et al. | 430/569 |
| 4,585,733 | 4/1986 | Ezaki et al. | 430/569 |

*Primary Examiner*—Richard L. Schilling
*Attorney, Agent, or Firm*—Jordan B. Bierman

[57] ABSTRACT

A process for manufacturing a silver halide direct positive type emulsion comprising primarily silver bromide prepared in the presence of a water-soluble rhodium salt said process comprising; simultaneously adding and mixing a silver aqueous solution and a halide aqueous solution to form an aqueous solution containing a hydrophilic colloid, said resultant mixture having a silver potential maintained with a range of from 100 mV to 200 mV, the speed at which the solutions are added being not more than the critical growth speed of existing silver halide grains, and fogging said silver halide grains.

8 Claims, No Drawings

MANUFACTURING PROCESS FOR SILVER HALIDE PHOTOGRAPHIC EMULSION

This application is a continuation of application Ser. No. 020147, filed 2/26/87, now abandoned, which claims the priority of Ser. No. 772,129, filed Aug. 30, 1985, now abandoned, which claims the priority of Japanese Application 193,339/84, filed Sept. 13, 1984.

BACKGROUND OF THE INVENTION

The present invention relates to the manufacturing process for a direct positive silver halide photographic emulsion. It particularly relates to the manufacturing process for an ultra-low sensitive direct positive silver halide photographic emulsion used for a photosensitive material capable of being used in a daylight room that is used in photoengraving for printing. Recently, a higher efficiency in a contact printing process has been requested in the printing field due to the complicated nature of prints or to the advancement of scanners. For this request, the improvements both in equipments such as printers and in photosensitive materials have been made and in the field of photosensitive materials, there has been developed an ultra-low sensitive (it is $10^{-4} \sim 10^{-5}$ times conventional contact printing film in sensitivity) silver halide photosensitive material called a daylight room photosensitive material and capable of being used in a daylight room illuminated by an ultraviolet intercepting fluorescent lamp, an incandescent electric lamp or by a yellow fluorescent lamp.

For the further improvement for higher quality, it is necessary to study and improve the composition, the shape and grain distribution etc. of silver halide grains for photographic emulsions. An example of the means therefor includes the pH conditions in preparation, the control of pAg conditions or the like and the improvement in the mixing method.

However, aforesaid well-known preparation method for silver halide grains do not, even after being applied to the preparation of photographic emulsions for direct positive daylight room photosensitive materials capable of being used for the duplex, result in a satisfactory level on the points of gamma of photographic characteristics curve Dmin and halftone quality etc.

SUMMARY OF THE INVENTION

An object of the present invention is to provide a manufacturing process of a silver halide photographic emulsion through which fog type direct positive daylight room photosensitive materials capable of being used for the high quality duplex may be obtained.

More specifically, the object of this invention is to provide a manufacturing process of an emulsion having a high contrast, a low Dmin and a good halftone quality.

Aforesaid object of the present invention may be achieved by a manufacturing process of a silver halide photographic emulsion having primarily silver bromide prepared in the presence of water-soluble rhodium salt, wherein a silver salt aqueous solution and a halide aqueous solution are simultaneously added and mixed in the aqueous solution containing hydrophilic colloid with a silver potential (EAg) value is kept within a range of $100 \sim 200$ mV at an adding speed not more than the critical growing speed of existing silver halide grains.

DETAILED DESCRIPTION OF THE INVENTION

The detailed description of the present invention will be made specifically as follows.

In the present invention, what silver halide primarily has silver bromide in its composition means that the silver bromide content in pure silver bromide or silver chlorobromide or in silver chloroiodobromide is at least 80 mol % and over regarding silver halide grains in an emulsion. In this case, it is preferable that the silver bromide content is not less than 90 mol %.

When the silver bromide content is low, Dmin in photographic properties is high and the reversibility is deteriorated, which is not desirable as a silver halide emulsion for the direct positive type use.

As a water-soluble rhodium salt to be used in the present invention, rhodium trichloride hydrate and ammonium hexachlororhodate etc. are given and complex compound of rhodium trichloride and halogen is preferable.

Preferable adding amount is $10^{-3} \sim 10^{-5}$ mol per mol of silver halide.

When the amount of water-soluble rhodium salt to be added exceeds $10^{-3}$ mol, the contrast becomes low and if the amount thereof is less than $10^{-5}$ mol, the reversibility is deteriorated.

When preparing a silver halide photographic emulsion in the presence of water-soluble rhodium compounds in the present invention, the water-soluble rhodium compounds may be added through any method at any moment of the grain-growing process such as the silver halide-precipitation-growth process and the physical ripening process or of the photographic characteristics-preparation process that is called a chemical ripening.

In this case, it is preferable that water-soluble rhodium compounds are added at the moment of precipitation and growth of silver halide and it is more preferable that they are added to the aqueous solution of water-soluble halides for preparation.

The EAg value in the present invention is a well-known concept among those skilled in the art and it represents a silver potential.

In this case, the EAg value is the one obtained from the measurement made by using a metallic silver electrode and a double junction type saturated Ag/AgCl comparative electrode. The EAg value in the present invention is the one obtained from the measurement made by using the electrode disclosed in Japanese Patent Publication Open to Public Inspection No. 197534/1982. Such EAg value may be kept in the range between 100 mV and 200 mV on the occasion of the addition in the simultaneous mixing method and it is preferable, in particular, that the EAg value will be kept in the range between 110 mV and 180mV.

The meaning of what the EAg value is kept in the range between 100 mV and 200 mV in this case is that the EAg value set at a any certain level in the aforesaid range of EAg value and the value may be changable within said range, preferably the value will be controlled to be constant.

As a means to control strictly the EAg value, it is preferable that an aqueous solution (halogen ion solution) of water-soluble halides is divided into two portions and one portion thereof will be used for the production of silver halide being added with halide ions in the mol amount which is approximately the same as that of silver ions added during a unit time in the course of addition of aqueous solution (silver ion solution) of water-soluble silver salt, and the other portion of halogen ion solution thereof will be added with chloride ions and bromide ions so that the change amount of EAg will be sufficiently small for the change in the EAg value and thus aforesaid other portion will be used for the control of the EAg value.

Incidentally, when the control is made with the EAg value that is lower than 100 mV, the emulsion prepared therefrom shows a low contrast as its property and a high fog.

If the EAg value exceeds 200 mV, on the other hand, it is near the equimolar point of silver ion and chlorine ion, thus it is substantially impossible to control, which results in the expanded distribution of grain size of the emulsion prepared under the aforesaid condition.

The critical growth speed of silver halide grains in the present invention means the upper limit increment of silver halide amount per unit time under which silver halides are deposited only on the existing silver halide grains when an aqueous solution (silver ion solution) of water-soluble silver salt and an aqueous solution (halogen ion solution) of water-soluble halide are added thereto and thus any fresh silver halide grains are not produced.

The upper limit value, namely, the critical growth speed mentioned here may be calculated from the process wherein actual crystals are formed through changing the adding speeds for silver ions and halogen ions variously, the samplings are picked up from the reaction container and they are observed under the electronic microscope for the confirmation of the existence of fresh crystalline nuclei produced newly.

In the present invention, a silver ion solution and a halide ion solution are mixed under the simultaneous mixing method.

In this case, any method of mixing may be used if the purpose of mixing will be attained but the method that offers a quick mixing-homogenization, namely, the method with a high mixing-efficiency is preferable. This is because a low mixing-efficiency causes EAg to rise or fall partially and changes the monodispersibility and emulsion characteristics.

As a hydrophilic colloid in the present invention, a water-soluble high polymer, for example a natural or synthesized high polymer such as gelatin or polyvinyl alcohol may be used independently or in the form of the mixture thereof.

The total amount of hydrophilic colloid is preferably within the range of 0.5~100 g for 1l of solution although there is no stipulation in particular.

The typical example of aqueous solution of water-soluble silver salt to be used in the present invention is an aqueous solution of silver nitrate.

Further, as an aqueous solution of water-soluble halide, aqueous solutions of potassium iodide, sodium iodide, potassium bromide, sodium bromide, potassium chloride and sodium chloride, for example, are given.

It is preferable in the present invention that the concentration of an aqueous solution of water-soluble silver salt and of an aqueous solution of water-soluble halide is 0.5~4.0 mol/l, through there is no stipulation in particular.

A silver halide photographic emulsion prepared in the aforesaid process is a monodispersibility emulsion whose silver halide grains have an average grain size of not larger than 0.3μ preferably and of 0.15~0.25μ more preferably.

In this case, the monodispersibility is shown as a coefficient of variation indicated with (standard deviation of grain size)/(average grain size)×100 and it is preferable that the monodispersibility is not higher than 15%, especially not higher than 10%.

Further, if the coefficient of variation exceeds 20%, it is difficult to obtain desirable properties in the photographic characteristics. This seems to be related to the chemical sensitizing performed after the physical ripening and grain preparation but details have not been cleared.

If the average grain size exceeds 0.3μ, the maximum density falls and the phenomenon to move toward a low contrast takes place.

The crystal habit is usually a cube but sometimes the grains having seemingly a rounded corner are produced.

In the preparation of the emulsion in the present invention, any of ammonia method, neutral method and acid method may be used and the neutral method or the acid method is preferable.

A silver halide photographic emulsion used in the present invention is given an optimum fog after the grain-growth process by reducing agents only or by the combination of reducing agent and gold-compound.

The conditions of the reaction for the silver halide to be fogged may be changed broadly and pH is usually within the range of pH 5.5~9 and it is preferably within the range of pH 6~7. PAg, on the other hand, is generally within the range of 6.5~8.5 and the temperature is generally within the range of 40° C.~100° C. and preferably within the range of 50° C.~75° C.

As a reducing agent to be used for aforesaid fog generation, organic reducing agent such as aldehyde compound like formalin and organic amine compound like hydrazine, triethylenetetramine, thioureadioxide and imino-amino-methanesulfonic acid, inorganic reducing agent like stannous chloride or a reducing agent like amine-borane are favorably used.

The concentration of the reducing agent to be used is changed in accordance with silver halide grains and the purpose of the application thereof etc. and it differs depending on the type of reducing agent and it is generally within the range of 0.05~50 milli equivalent per mol of silver halide. If the concentration of the reducing agent is not higher than 0.05 milli equivalent per mol of silver halide, the sensitivity will not be lowered to the value which is necessary for the use in the daylight room that is a target of the present invention and the safety for illumination will also be deteriorated. If the concentration of the reducing agent is not lower than 50 milli equivalent, on the other hand, the contrast is very low and Dmin is high, which results in insufficient characteristics.

Gold-compounds used in the present invention are monovalent and trivalent soluble gold salts and, for example, chloroauric acid, gold thiocyanate, sodium chloroaurate, potassium aurate, potassium chloroaurate, potassium bromoaurate, potassium iodoaurate, potassium gold cyanide, potassium gold thiocyanate, gold sodium thiomaleate and gold thioglucosate etc. are used.

The amount of gold-compound to be used will be changed according to the size and composition of silver halide grains or to the purpose of the application and it is generally within the range of 0.0001~0.1 milli mol per mol of silver halide and preferably within the range of 0.005~0.05 milli mol.

Further, it is possible to add a stabilizer like tetrazaindenes, antifoggant like indazoles, imidazoles, triazoles and tetrazoles, a covering power improver, a humectant, latexs, dyes that absorb and cut visible rays such as oxazole dye, azo dye and benzylidene dye etc. and other general additives to be used for the photographic emulsion such as a spreading agent and a hardener etc. to the emulsion prepared through the aforesaid manner.

A silver halide emulsion related to the present invention is coated on the support which is the one usually used for the photosensitive material such as a polyester base, a baryta paper, a laminate-processed paper and a glass.

As a developer for the silver halide emulsion related to the present invention, any of the developer used for the usual silver halide photosensitive material and the lith developer may be used.

EXAMPLES

The present invention will be explained as follows more specifically referrring to the examples to which the present invention is not limited.

EXAMPLE 1

Silver bromide emulsions EM-1~EM-5 were prepared by the use of A-liquid, B-liquid and C-liquid shown below.

Solution A

Ossein gelatin: 5.7 g
Polyisopropylene-polyethylene oxide 10% ethanol solution: 2.8 ml
$MgSO_4$: 2.5 g
Distilled water: 1300 ml Solution B Silver nitrate: 170 g
Distilled water: 386.8 ml Solution C Potassium bromide: 118.9 g
Polyisopropylene-polyethylene oxide 10% ethanol solution: 2.3 ml
Rhodium trichloride trihydrate: 25.5 mg
Ossein gelatin: 6.2 g
Distilled water: 373.4 ml After potassium bromide was added to the solution A, the solution B and the solution C were added thereto at a temperature of 55° C. through a double-jet method by the use of a mixing-stirring machine shown in Japanese Patent Publication Nos. 58288/1983 and 58289/1983 over the period of time shown in Table 1 so that the prescribed EAg values shown in Table 1 may be obtained.

As shown in Table 2~Table 6 concerning and adding speed, an amount to be added was increased with the lapse of time.

TABLE 1

EAg value and adding time for each emulsion

| Em No. | Prescribed EAg value (mV) | Adding time (minute) |
|---|---|---|
| Em-1 (Comparative) | 220 | 47 |
| Em-2 (This invention) | 170 | 58 |
| Em-3 (This invention) | 140 | 69 |
| Em-4 (This invention) | 110 | 75 |

TABLE 1-continued

EAg value and adding time for each emulsion

| Em No. | Prescribed EAg value (mV) | Adding time (minute) |
|---|---|---|
| Em-5 (Comparative) | 80 | 85 |

TABLE 2

EM-1 adding speed (EAg 220 mV, adding time 47 minutes)

| Adding time (minute) | B solution (ml/min) | C solution (ml/min) |
|---|---|---|
| 0 | 2.8 | 2.8 |
| 2 | 2.8 | 2.7 |
| 7' | 4.8 | 4.7 |
| 10' | 5.7 | 5.6 |
| 19 | 7.7 | 7.6 |
| 26 | 8.8 | 8.7 |
| 32 | 9.9 | 9.8 |
| 37 | 10.8 | 10.7 |
| 43 | 11.3 | 11.2 |
| 47 | 11.9 | 11.8 |

TABLE 3

EM-2 adding speed (EAg 170 mV, adding time 58 minutes)

| Adding time (minute) | B solution (ml/min) | C solution (ml/min) |
|---|---|---|
| 0 | 2.3 | 2.3 |
| 2 | 2.3 | 2.2 |
| 8 | 3.9 | 3.8 |
| 19 | 5.8 | 5.7 |
| 28 | 6.9 | 6.8 |
| 36 | 7.7 | 7.6 |
| 43 | 8.2 | 8.2 |
| 50 | 8.9 | 8.7 |
| 58 | 9.5 | 9.4 |

TABLE 4

EM-3 adding speed (EAg 140 mV, adding time 69 minutes)

| Adding time (minute) | B solution (ml/min) | C solution (ml/min) |
|---|---|---|
| 0 | 1.9 | 1.8 |
| 2 | 1.9 | 1.8 |
| 9 | 3.4 | 3.3 |
| 22 | 4.9 | 4.8 |
| 33 | 5.7 | 5.6 |
| 43 | 6.4 | 6.3 |
| 51 | 6.9 | 6.8 |
| 59 | 7.4 | 7.3 |
| 69 | 7.8 | 7.7 |

TABLE 5

EM-4 adding speed (EAg 110 mV, adding time 75 minutes)

| Adding time (minute) | B solution (ml/min) | C solution (ml/min) |
|---|---|---|
| 0 | 1.7 | 1.7 |
| 2 | 1.7 | 1.6 |
| 9 | 3.1 | 3.0 |
| 24 | 4.5 | 4.4 |
| 36 | 5.3 | 5.2 |
| 46 | 5.9 | 5.8 |
| 56 | 6.4 | 6.3 |
| 64 | 6.8 | 6.7 |
| 75 | 7.2 | 7.1 |

TABLE 6

EM-5 adding speed (EAg 80 mV, adding time 85 minutes)

| Adding time (minute) | B solution (ml/min) | C solution (ml/min) |
|---|---|---|
| 0 | 1.4 | 1.4 |
| 2 | 1.4 | 1.3 |

TABLE 6-continued

| EM-5 adding speed (EAg 80 mV, adding time 85 minutes) | | |
|---|---|---|
| Adding time (minute) | B solution (ml/min) | C solution (ml/min) |
| 11 | 2.7 | 2.6 |
| 28 | 4.0 | 3.9 |
| 41 | 4.6 | 4.5 |
| 53 | 5.2 | 5.1 |
| 63 | 5.6 | 5.5 |
| 73 | 5.9 | 5.8 |
| 85 | 6.2 | 6.1 |

In the foregoing, while B solution and C solution were added, the EAg value was controlled by the use of potassium bromide 0.1 mol/l aqueous solution so that the value of EAg shown in Table 1 may be obtained. For the measurement of EAg values, a metallic silver electrode and a double junction type saturated Ag-/AgCl comparative electrode were used and the constitution of the electrode was of a double junction type disclosed in Japanese Patent Publication Open to Public Inspection No. 197534/1982.

On the other hand, a variable-flow type roller-tube quantitative pump was used for adding B solution and C solution. The reason of what the adding time differs depending on each sample is that the adding time determined experimentally so that an average grain size of silver halide grains prepared becomes mostly the same was used.

Further, through the sampling of emulsions made during the adding operation, it was observed by the use of an electronic microscope that fresh grains were not generated newly in the system and it was confirmed that the amount of addition was not the one that exceeds the critical growth speed in the system.

Incidentally, during the period of adding operation, the control was made by an aqueous solution of 1% nitric acid so that the pH value might be kept at 2.0.

After B solution and C solution have been added, all emulsions were subjected to Ostwald ripening for 10 minutes and then the EAg value was controlled to −20 mV by potassium bromide and the pH value was adjusted to 5.4 by sodium carbonate. After that, desalting and washing were conducted thereto through the normal method and then 600ml (containing ossein gelatin 30g) of aqueous solution of ossein gelatin was added thereto and the emulsion was stirred for 30 minutes at 55° C. and then was prepared to be 750cc.

An average grain size and a coefficient of variation were measured and calculated by an electronic microscope for each of EM-1 ~ EM-5 emulsions thus obtained and the results thereof are shown in Table 7.

TABLE 7

| average grain size and grain size distribution of each emulsion | | |
|---|---|---|
| EM No. | Average grain size (μ) | Average distribution (%) |
| EM-1 (Comparative) | 0.19 | 13 |
| EM-2 (This invention) | 0.21 | 10 |
| EM-3 (This invention) | 0.20 | 7 |
| EM-4 (This invention) | 0.19 | 9 |
| EM-5 (Comparative) | 0.21 | 15 |

*grain size distribution (coefficient of variation)

$$\text{coefficient of variation} = \frac{\text{standard deviation of grain size}}{\text{average grain size}} \times 100$$

As shown in Table 7, all emulsions EM-1 ~ EM-5 have their average grain size of 0.20μ±0.01, which means that the emulsions approximately the same on the point of an average grain size were obtained. The table shows that EM-2, 3 and 4 in the present invention are a monodisperse emulsion having a lower coefficient of variation, compared with other comparative emulsions.

Next, 12mg of thioureadioxide per mol of silver halide was added to each of aforesaid emulsions and each emulsion was then ripened at 65° C. until its property reaches the maximum level and then was fogged. Further, saponin was added to the emulsion as a coating aid and formalin was added as a hardener and the emulsion was coated on a PET base so that the silver amount reaches the value of 3.4g/m$^2$ and then dried.

The samples thus obtained were subjected to the wedge exposure on the printer D-605 FS manufactured by Dai Nippon Screen Co. and then were developed for 20 seconds at 38° C. by the use of the developer shown below, the results therefrom are shown in Table 8.

Developer

| | |
|---|---|
| Ethylenediaminetetraacetic acid-disodium salt | 1 g |
| 5-methylbenzotriazole | 0.3 g |
| 1-phenyl-5-mercaptotetrazole | 0.1 g |
| Potassium sulfite | 90 g |
| Potassium bromide | 4 g |
| Hydroquinone | 25 g |
| Potassium carbonate | 15 g |
| Diethyleneglycol | 35 g |
| 1-phenyl-4,4-dimethyl-3-pyrazolidone | 0.5 g |
| Potassium hydroxide | pH adjusted to 10.7 |
| Water to make 1 | |

Further, the samples were subjected to the exposure through a screen of 50% dots for forming a 50% halftone on the printer P-605 FS manufactured by Dai Nippon Screen Co. and then were developed for 20 seconds at 38° C. in the developer shown above, the results therefrom are shown in Table 8 as the foregoing.

Incidentally, γ in Table 8 represents a gradient of the curve corresponding to the density from 0.3 to 2.5 and the halftone qualities (hereinafter abbreviated as DQ) are appraised through the 5-step evaluation in order of excellence rank and a large figure means a halftone quality which is more excellent.

TABLE 8

| | gamma (γ) | DQ | Dmin |
|---|---|---|---|
| EM-1 | 4 | 3.5 | 0.06 |
| EM-2 | 5.5 | 4.5 | 0.04 |
| EM-3 | 6 | 5 | 0.04 |
| EM-4 | 5.8 | 4.5 | 0.04 |
| EM-5 | 3.5 | 3.0 | 0.05 |

As shown in Table 8, EM-2, 3 and 4 of the present invention have a low Dmin compared with comparative samples and thereby it is understood that the emulsions of this invention are of a high contrast type. Incidentally, all samples showed an ultra-low sensitivity and there was no big difference of sensitivity among EM-1 ~ 5 emulsions.

EXAMPLE 2

Emulsions EM-6 ~ EM-10 having changed silver halide composition were prepared in a manner exactly the same as that for EM-3 in Example 1. Table 9 shows a composition for each of the emulsions.

TABLE 9

| | AgBr:AgCl |
|---|---|
| EM-6 | 95:5 |
| EM-7 | 90:10 |
| EM-8 | 85:15 |
| EM-9 | 75:25 |
| EM-10 | 70:30 |

An average grain size for each of the emulsions having aforesaid composition was $0.20 \pm 0.01\mu$ uniformly and the coefficient of variation was within 10% and no difference thereof existed among EM-6~EM-10. After these emulsions were ripened in the same manner as Example 1, saponin as a coating aid and formalin as a hardener were added thereto and each emulsion was coated on a PET base so that the amount of silver thereon reaches the value of 3.4 $g/m^2$ and then was dried.

Samples thus obtained were subjected to the exposure and processing in the same manner as Example 1 and the results therefrom are shown in Table 10.

TABLE 10

| | gamma ($\gamma$) | DQ | Dmin |
|---|---|---|---|
| EM-6 | 5 | 5 | 0.04 |
| EM-7 | 5 | 4.5 | 0.05 |
| EM-8 | 4.5 | 4.0 | 0.05 |
| EM-9 | 3.5 | 3.5 | 0.07 |
| EM-10 | 3.0 | 3.0 | 0.09 |

As shown in Table 10, EM-6, 7 and 8 in the present invention have a lower Dmin compared with comparative samples and it is understood from the table that the emulsions of this invention are of a high contrast type.

What is claimed is:

1. A process for manufacturing a silver halide direct positive type emulsion comprising primarily silver bromide prepared in the presence of a water-soluble rhodium salt said process comprising;

simultaneously adding and mixing a silver salt aqueous solution and a halide aqueous solution to form an aqueous solution containing a hydrophilic colloid, said resultant mixture having a silver potential maintained within a range of from 100 mV to 200 mV, the speed at which the solutions are added being not more than the critical growth speed of existing silver halide grains, and fogging said silver halide grains.

2. The manufacturing process of a silver halide photographic emulsion according to claim 1 wherein the silver bromide content of aforesaid silver halide photographic emulsion is not less than 80 mol %.

3. The manufacturing process of a silver halide photographic emulsion according to claim 1 wherein the silver bromide content of aforesaid silver halide photographic emulsion is not less than 90 mol %.

4. The manufacturing process of a silver halide photographic emulsion according to claim 1 wherein the coefficient of variation of aforesaid silver halide photographic emulsion is not more than 15%.

5. The manufacturing process of a silver halide photographic emulsion according to claim 1 wherein an existing amount of aforesaid water-soluble rhodium salt is $10^{-3} \sim 10^{-5}$ mol per mol of silver halide.

6. The manufacturing process of a silver halide photographic emulsion according to claim 1 wherein aforesaid silver potential (EAg) is kept within a range of 110~180 mV.

7. The manufacturing process of a silver halide photographic emulsion according to claim 1 wherein the total amount of aforesaid hydrophilic colloid is 0.5~100 g per liter of solution.

8. The manufacturing process of a silver halide photographic emulsion according to claim 1 wherein the average grain size of aforesaid silver halide photographic emulsion is $0.15 \sim 0.25\mu$.

* * * * *